US005957186A

United States Patent [19]

Boswell

[11] Patent Number: 5,957,186

[45] Date of Patent: Sep. 28, 1999

[54] HIGH IMPACT RESISTANT STORM SHUTTERS

[76] Inventor: James C. Boswell, 1161 SW. 73rd Ave., Plantation, Fla. 33317

[21] Appl. No.: 09/048,819

[22] Filed: Mar. 26, 1998

Related U.S. Application Data

[63] Continuation of application No. 08/709,383, Sep. 6, 1996, abandoned.

[51] Int. Cl.[6] ..... E05D 15/06

[52] U.S. Cl. ..... 160/201; 160/183; 160/232; 160/236; 49/63; 49/410; 52/592.1

[58] Field of Search ..... 160/183, 232, 160/235, 236, 118, 201, 207, 214, 229.1; 49/63, 409, 410, 425; 52/592.1, 539

[56] References Cited

U.S. PATENT DOCUMENTS

| | | | |
|---|---|---|---|
| 2,021,922 | 11/1935 | Peck | 52/592.1 X |
| 2,913,046 | 11/1959 | Sharp et al. | 49/63 |
| 3,452,477 | 7/1969 | Sassano | 160/183 |
| 3,485,287 | 12/1969 | Milbourne, Sr. | 160/235 |
| 3,959,830 | 6/1976 | Van Der Broek | 4/172.19 |
| 4,634,172 | 1/1987 | Duda | 160/235 X |
| 4,799,526 | 1/1989 | Reeves | 160/168.1 |
| 5,186,382 | 2/1993 | Doughty | 228/135 |
| 5,469,905 | 11/1995 | McKinney et al. | 160/183 X |
| 5,502,939 | 4/1996 | Zadok et al. | 52/592.1 X |
| 5,549,148 | 8/1996 | Figueiredo et al. | 160/183 |
| 5,566,739 | 10/1996 | Hoffman | 160/183 |
| 5,601,130 | 2/1997 | Werner et al. | 160/183 |
| 5,622,012 | 4/1997 | Schijf | 160/232 X |
| 5,715,854 | 2/1998 | Andrieux et al. | 52/592.1 X |
| 5,740,850 | 4/1998 | Hoffman | 160/183 |

FOREIGN PATENT DOCUMENTS

| | | | |
|---|---|---|---|
| 12039 | of 1899 | United Kingdom | 52/593 |

*Primary Examiner*—Daniel P. Stodola
*Assistant Examiner*—Bruce A. Lev
*Attorney, Agent, or Firm*—Malin, Haley, DiMaggio & Crosby

[57] ABSTRACT

A high impact shutter capable of withstanding high impacts from flying debris, including large debris, for use on exterior wall openings such as doors and windows, particularly suited for use in violent storms such as hurricanes. The high impact shutter can be retrofit to existing shutter systems using products already installed, or used in entirely new installations. The high impact shutters may be made into panels that include a plurality of interconnected parallel slats held together by a perimeter framework. The shutter slats may or may not have small openings to provide ventilation and to allow passage of light.

16 Claims, 4 Drawing Sheets

HIGH IMPACT RESISTANT STORM SHUTTERS

This invention was disclosed in the Disclosure Documents Program of the U.S. Patent and Trademark Office on Aug. 22, 1994, Disclosure Document No. 360087, and on Aug. 19, 1996, Disclosure Document No. to be assigned.

This application is a continuation of Application Ser. No. 08/709,383, filed Sep. 6, 1996 now abandoned.

BACKGROUND OF THE INVENTION

1. Field of the Invention

This invention relates to shutters for use on exterior wall openings such as doors and windows, and more particularly to shutters capable of withstanding high impacts from flying debris, including large debris, and particularly suited for use in violent storms such as hurricanes.

2. Description of Related Art

Shutters for the protection of exterior doors and windows during storms are known in the art. For example, in coastal areas, shutters, commonly called hurricane shutters, are regularly used to protect doors and windows during the high winds generated by hurricanes and other storms. Shutters are also used by residents during periods of extended absence.

Shutters are typically placed on the exterior of a door or window and are operated either from the outside or inside of the building structure. Operation from the interior of a building structure is particularly important for use in two or more story homes or high-rise apartment buildings, hotels, and the like where exterior operation might be cumbersome.

Shutters may be made of one or more pieces of metal or other sturdy material placed in a supportive frame external to the window or door to be protected. Shutters may be configured in panels which have a perimeter framework holding an interconnected plurality of vertical or horizontal pieces of material called slats, which are commonly generally rectangular in shape and made of metal. The slats may or may not provide small openings or slits to allow for ventilation and entry of light.

Shutter panels may be used singularly in an external supportive frame, but typically are used in pairs and multiple pairs to cover wider areas without having to make extremely large shutter panels. A panel, or pairs and multiple pairs of shutter panels, may be held in an external supportive framework having a guide track, or parallel guide tracks, such that the panel, or the plurality of panels, can slide horizontally with each panel on a separate track.

The supportive framework can be made wider than the door or window to be protected permitting the panel or panels to be stored in the open position, on one side or both sides of, and completely unobstructing, the door or window opening. Typically, multiple panels are stored on either side of the window or door, and the width of the panels and frame are selected such that the panels mate together in a closed position completely covering the door or window, and stack in parallel orientation in the open position completely unobstructing the door or window.

An example of a shutter assembly, similar to that described herein, and which is completely operable from the interior of the building structure, is shown in U.S. Pat. No. 3,452,477, to Sassano (the '477 patent), the disclosure of which is incorporated herein by reference.

In many coastal hurricane prone areas of the country, storm shutters must meet building code requirements. In the aftermath of hurricane Andrew, which hit South Florida on Aug. 24, 1992, the building code requirements in South Florida were made significantly more stringent. The South Florida Building Code, one of the most stringent in the United States, now requires storm shutters to meet large and small missile impact tests For example, for a large missile impact test, the shutter must withstand two impacts from a 2×4 inch wooden missile, weighing 9 pounds, fired from an air cannon at 50 feet per second (34 m.p.h.).

The shutters currently available, such as those disclosed in '477, cannot withstand the described large missile impact test. Among the shutter's failures in the test, the slats collapse, separating at the interconnection points and from the perimeter frame allowing the missile to pass through the shutter. To meet the stringent building code requirements, shutter manufacturers are adding backing support material to strengthen existing shutter designs. This often requires modification or replacement of existing support frame members. In addition, for panels having slats with slits for ventilation and/or lighting as shown in FIG. of '477, the backing support material can block the slits preventing ventilation and sunlight.

There exists a need for a storm shutter, similar to that described in the '477 patent, that during operation can be stacked in the storage configuration, and which can be vented or unvented. The shutter can be similar in appearance to existing shutters, such as the shutters of the '477 patent, thus allowing it to be retrofited to existing products already installed. The shutter must withstand stringent high impact large and small missile tests as mandated in some communities such as South Florida, as well as hurricane force winds.

SUMMARY OF THE INVENTION

The present invention provides a high impact resistant storm shutter that addresses the limitations and failures of the current shutters discussed above. The provided shutter has interlocking slats, can be stackable during storage, can be vented or unvented, can be retrofitable to existing products already installed, and withstands high impact large and small missile tests and hurricane force winds.

The high impact tests are conducted to simulate wind thrown debris that could be present during violent storms such as hurricanes. The slats of the present invention are the only slats known to have passed high impact tests conducted according to the South Florida Building Code. The slats of the present invention can also be retrofitable to prior art shutter assemblies, can be similar in appearance to prior art shutters, are easy to assemble, and provide ventilation and the passage of light.

The present invention includes a novel slat interconnecting mechanism using a slat with a preselected thickness to meet the requirements of stringent building codes. When made from aluminum, each slat must be thicker than the 0.020 inches presently utilized for prior art slats. Each slat has upper and lower edges formed into novel male and female interconnection members which are described fully herein below. For a slat made of extruded aluminum having the novel edge features of the present invention, a slat thickness of substantially at least 0.062 inches has been found to be preferable, and has passed South Florida missile impact testing requirements.

Shutter panels contain multiple slats interconnected at corresponding male and female edge connection members. The male and female edge connection members not only meet high impact large and small missile tests, but additionally provide for ease of assembly and maintenance. The male and female interconnection members are designed such that, when interconnected, the slats of the present invention resemble slats already in use, such as the slats of the '477 patent.

The interconnected slats are held together by a shutter panel perimeter framework, similar to prior art panels. The interconnected slats can be retrofit to prior art panels utilizing the prior art perimeter framework hardware. In one embodiment, the shutter panel frame of the present invention resembles, and is made using similar components to, that disclosed in the '477 patent.

In another embodiment, the interconnected slats are held together by a perimeter framework having greater "rabbet" depths in the "vent jambs". This is accomplished by having wider vertical frame members, or vent jambs, and extending the slats farther into the vertical frame members (vent jambs). The distance the slat penetrates the vent jamb is the rabbet depth. Hence, increasing vent jamb rabbet depth permits the slats to be deflected farther without disengaging from the vent jamb. The shutter can thus withstand greater impacts. In this embodiment the present invention resembles the prior art shutters with the vertical perimeter frame members being wider than prior art vertical frame members.

The shutter panels of the present invention can utilize a support frame having tracks, similar to that disclosed in '477, for installation covering a door or window. The shutter panels of the present invention have similar vent head and vent sills (upper and lower horizontal perimeter frame members) as the prior art shutter panel and can utilize the existing prior art shutter support frames and tracks. For example, because the shutters of the present invention may resemble those of the '477 patent, they are retrofitable to existing products already installed. This is an important feature because, for example, it allows some residents living in a multi-unit dwelling having an existing installation of prior art shutters to upgrade to the panels of the present invention, utilizing the existing support frame and tracks, while maintaining the uniform appearance of the dwelling's shutters.

As in the '477 patent, slats of the present invention can have slits for ventilation. Unlike prior art panels, vented or unvented panels of the present invention withstand high impact large and small missile tests as mandated by building codes such as South Florida Building Code.

Accordingly, it is an objective of the present invention to provide a high impact resistant storm shutter that has interlocking slats that can withstand building code standards for storm shutters such as the South Florida Building Code as well as hurricane force winds.

It is another objective of the present invention to provide a high impact resistant storm shutter that can provide ventilation.

It is still another objective of the present invention to provide a high impact resistant storm shutter that resembles prior art shutters and is retrofitable to existing shutter installations utilizing existing hardware.

It is yet another objective of the present invention to provide a high impact resistant storm shutter that is stackable during storage.

In accordance with these and other objects which will become apparent hereinafter, the instant invention will now be described with particular reference to the accompanying drawings.

DESCRIPTION OF THE PREFERRED EMBODIMENTS

Figure 1:
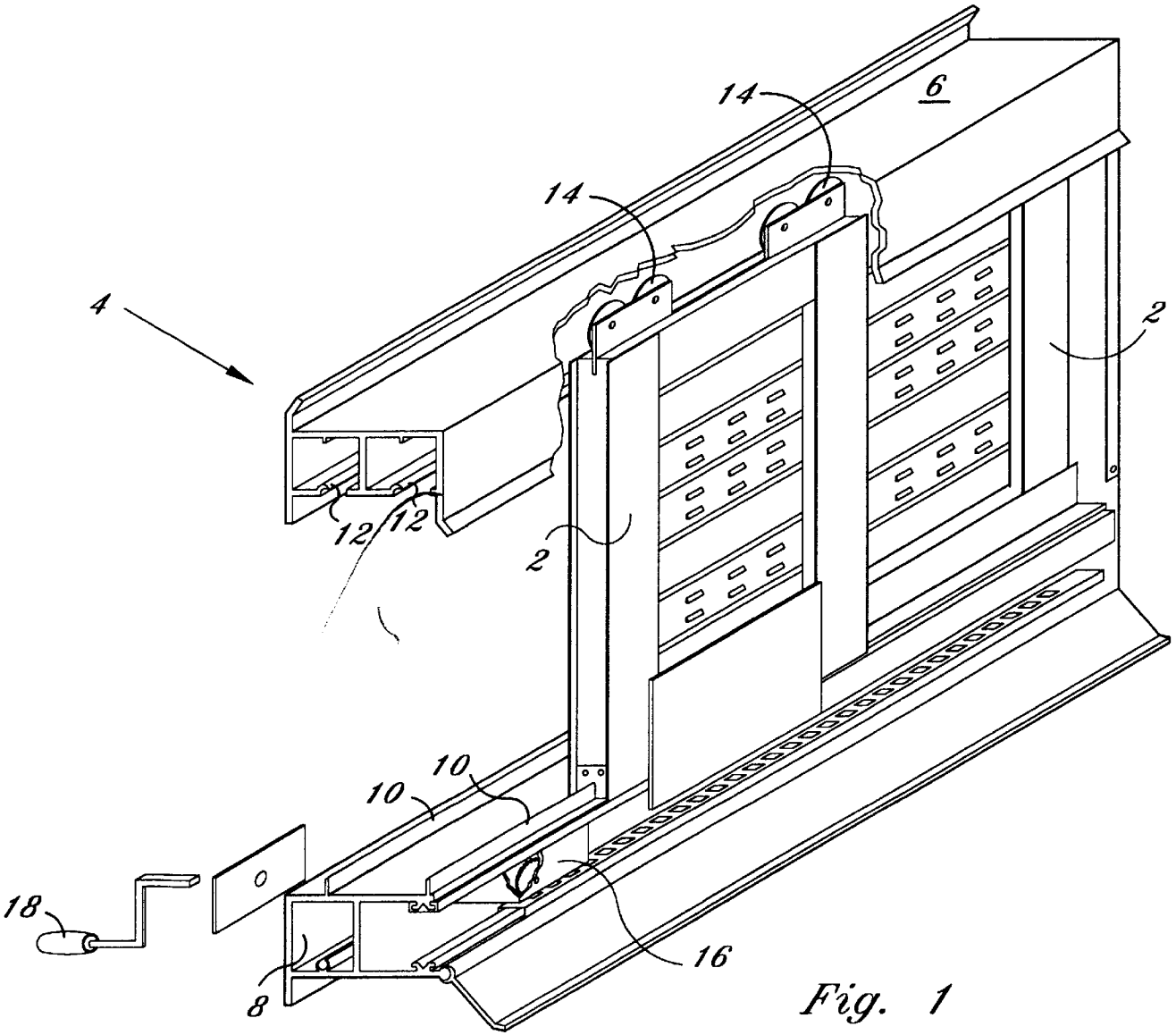
FIG. 1 is a perspective view in partial cut-away of the present invention showing an embodiment installed in a shutter assembly.

Referring now to the figures and in particular to FIG. 1, one embodiment of the present invention, shown generally as high impact shutter panel 2, is installed singularly, or in multiples, in a support and guide frame, shown generally as 4. Support and guide frame 4 includes upper rail 6 and lower rail 8. Lower rail 8 may include one or more tracks 10 and upper rail 6 may include one or more corresponding guide means 12. Guide means 12 may be a guide and retainer for rollers 14 which can be attached to panel 2. Multiple tracks 10 and guide means 12 are positioned parallel to adjacent tracks and guides means.

Rails 6 and 8, tracks 10, and guide means 12 are used to supportively position high impact shutter panel 2. Tracks 10 and guide means 12 provide for movement of panel 2 between an open position, unobstructing a door or window, and a closed position completely covering the door or window to be protected, as shown in FIGS. 1 and 2 of the '477 patent.

In the open position panel 2 will be stored on track 10 and guide means 12 to one side of the window or door to be protected. In the open position, multiple panels 2 will be stacked adjacent each other on parallel tracks 10 to one or both sides of the window or door as shown in FIG. 1 of the '477 patent.

Movement of panel 2 from the open to the closed position can be accomplished using rack and pinion drive assembly 16 which is accessed by hand crank 18 from inside the building structure to be protected. Alternately, instead of rack and pinion drive assembly 16, panels 2 can be manually moved from outside the structure. Additionally, other conventional frame structures can be utilized, and are considered within the scope of the invention.

Figure 2:
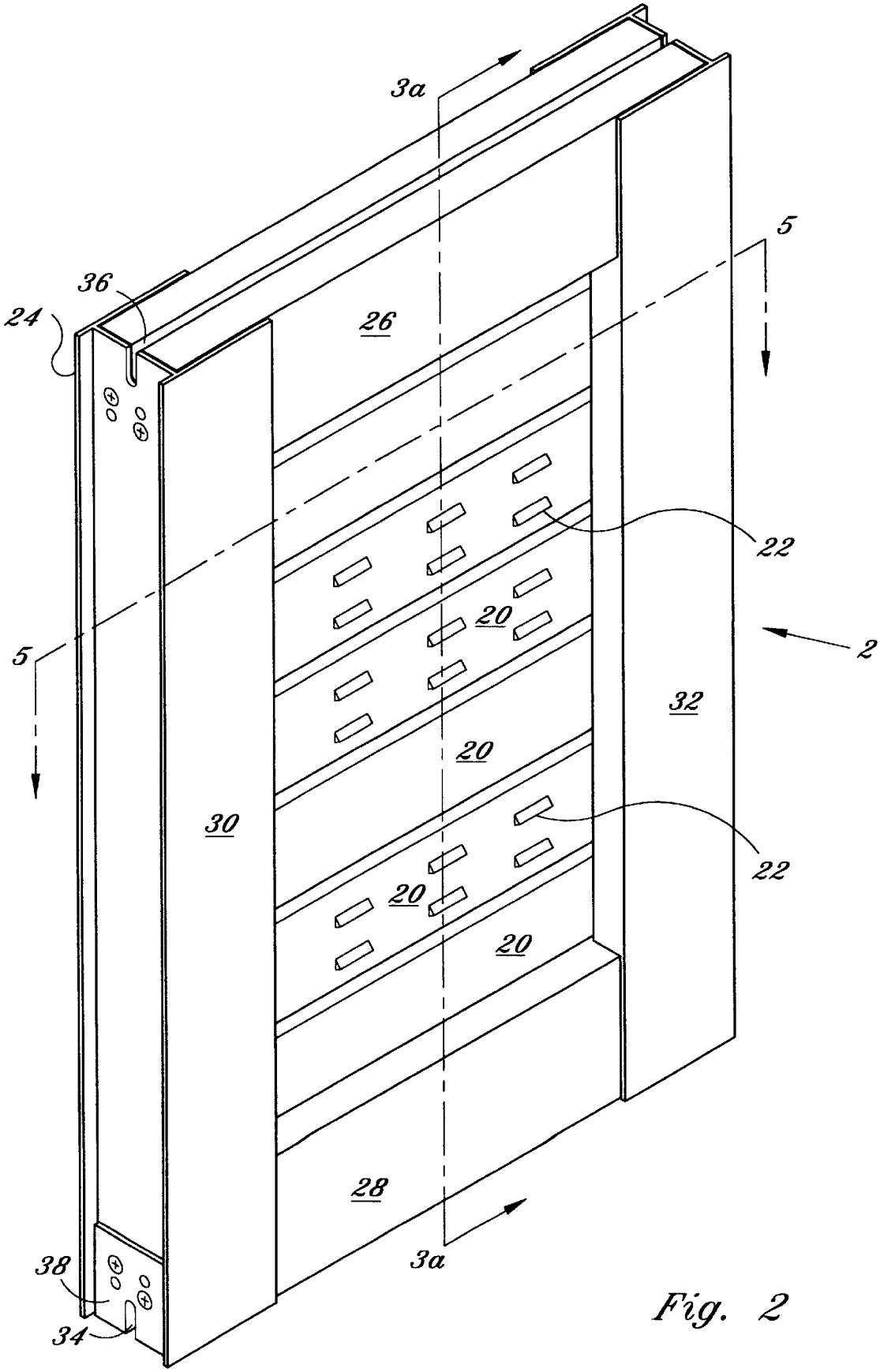
FIG. 2 is a perspective view of a shutter panel of the present invention.

Referring now to FIG. 2, high impact shutter panel 2 includes a plurality of slats 20. All or a portion of slats 20 in panel 2 may include vents 22 to provide ventilation and allow light to pass through shutter panel 2. Slats 20 are surrounded by a perimeter framework 24, made up of vent head 26, vent sill 28, and vertical vent jambs 30 and 32. Slots 34 and 36 can be provided in vent sill 28 and vent head 26, respectively, for slidable engagement with tracks 10 and guide means 12 respectively. Nylon guides 38 can be provided on vent sill 28 at slot 34 for quiet operation.

Figure 3A:
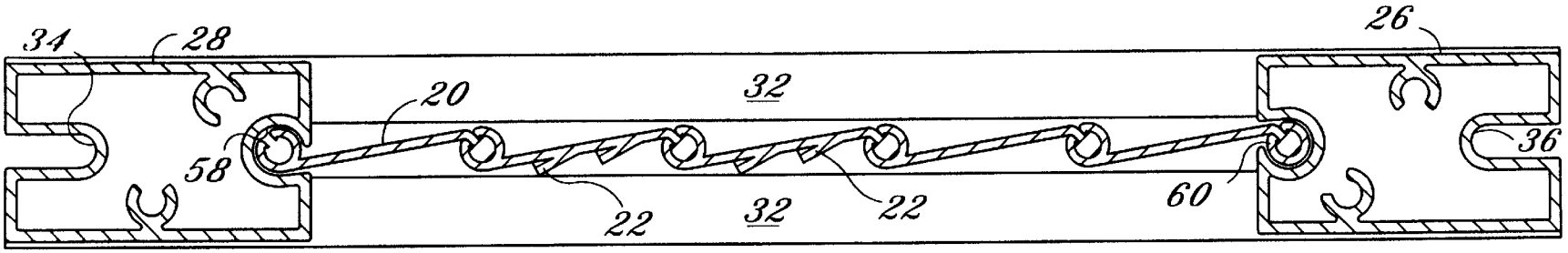
FIG. 3*a* is a cross-sectional view taken along line 3*a*–3*a* in FIG. 2.
Figure 3B:
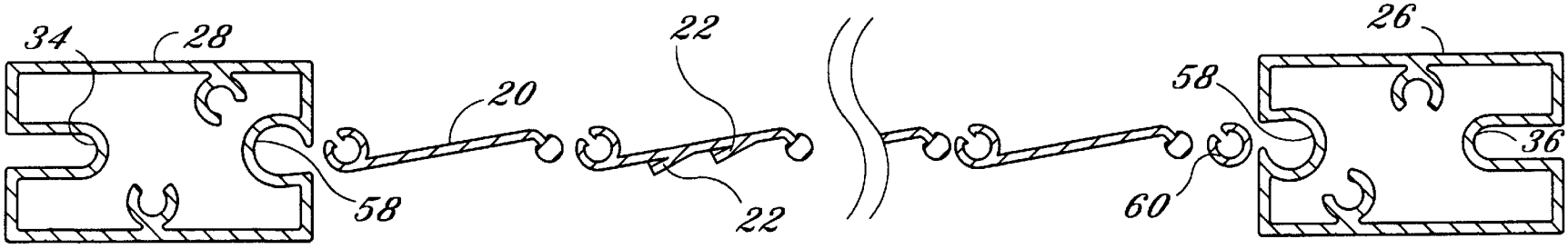
FIG. 3*b* is a partial exploded view of that shown in FIG. 3*a*.
Figure 4:
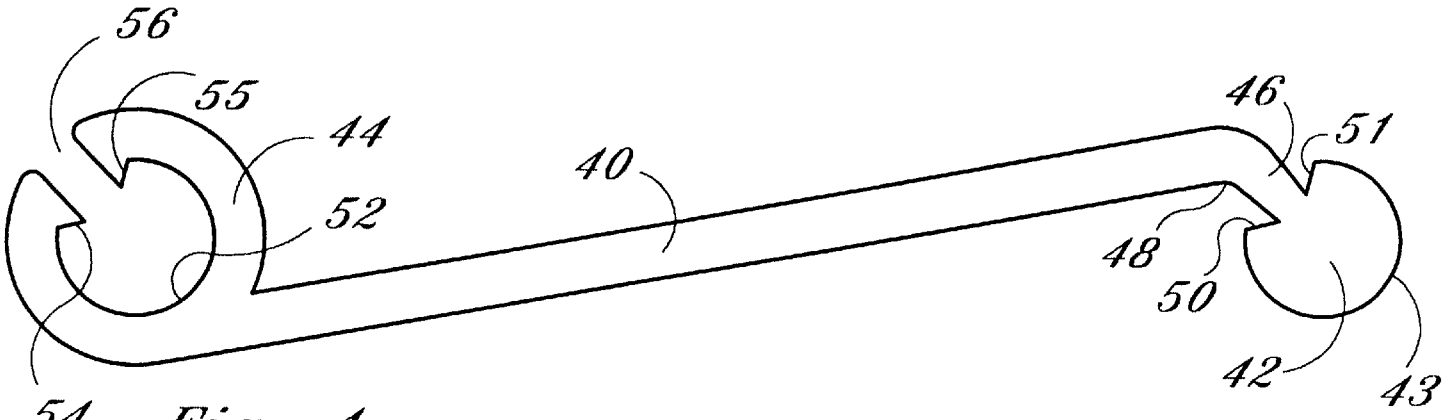
FIG. 4 is a side elevational view of a slat of the present invention.

Referring now to FIGS. 3*a*, 3*b*, and 4, slat 20 is comprised generally of body portion 40, male end 42, and female end 44. Body portion 40, male end 42, and female end 44 run the entire length of slat 20 from end to end, but are shown in end view in FIG. 4. Male end 42 and female end 44 are on opposite sides of body portion 40. Slat 20 is made of any suitable material. Extruded 6063 aluminum has been found to work well during testing, but the slats can be constructed of a different material and such other material are considered within the scope of the invention.

Body portion 40 of slat 20, that is made of extruded aluminum, can be at least approximately 0.062 inches thick, and preferably it should be substantially about 0.062 inches thick. Neck portion 46 located between male end 42 and bend radius 48 can be about 0.046 inches thick. Slats made of other materials may require different thicknesses to meet testing requirements and, as stated above, are considered within the scope of the invention.

Male end 42 comprises an essentially circular surface 43 ending in shoulders 50 and 51 near neck portion 46. Shoulders 50 and 51 can each be about 45 degrees measured in relation to the center line of neck portion 46.

Female end 44 comprises a donut shape having an inner surface 52, flanges 54 and 55, and aperture 56. Inner surface 52 and outer surface 43 are sized such that outer surface 43 essentially fills inner surface 52 with shoulders 50 and 51 locked against flanges 54 and 55. Aperture 56 is sized slightly larger that neck portion 46. Flanges 54 and 55 can each be about 45 degrees measured in relation to the center line of slot 56.

Female end 44 thus receives male end 42 such that interconnected slats are in movable engagement with each other to allow the adjacent slats to be slid together. As seen in the drawings, once properly assembled, the slats are interconnected in a virtually unmovable engagement within the framework.

The tolerances between female end 44 and male end 42 further ensure that slats 20 are easily placed in, and maintained in, parallel alignment with adjacent slats 20, vent head 26, and vent sill 28, as seen in FIG. 2.

Referring to FIG. 11 of '477, the prior art slat attachment configuration can be seen. The interconnect of the prior art slats is accomplished by concentric engagement of circular portions 152. The thin metal and tolerances of the circular portions of the prior art slats made proper parallel alignment of adjacent slats difficult and tedious. The curvature of circular metal portions 152 often had to be manually bent after inserting into adjacent slats to get the slats to appear parallel. The slats 20 of the present invention solve this problem. Furthermore, the combination of the preferred selected thickness of substantially about 0.062 inches and the interconnection of male 42 and female 44 ends provides for easy parallel orientation of adjacent slats 20 and the ability to withstand high impacts from both large and small missiles.

The interconnection and end position of slats 20 is best seen in FIG. 3*a*. Vent head 26 and vent sill 28 both have circular shaped pockets 58. As can be seen in FIG. 3*b*, vent head 26 and vent sill 28 are identical parts with one upside down in relation to the other. Adapter 60 is needed to connect vent head 26 with a slat 20. Adapter 60 is merely a female end 44 of slat 20 minus body portion 40 and male end 42.

The proper position of adjacent slats 20 in panel 2 is determined by bend 48 and the angular position of aperture 56. As can be seen in FIG. 3*a*, in the proper position, the interconnected slats 20 and vent head 26 and vent sill 28 align in a vertical plane when viewed from the end. To properly position slats 20, it is important that the center of circular surface 43 and the center of circular surface 52 be vertically coplanar when the slats are interconnected.

All or a portion of slats 20 can have apertures 22 to provide ventilation and light when the shutters are closed, as shown in FIGS. 2, 3*a*, and 3*b*. Apertures or vents 22 are preferably made of a small horizontal slit with the upper portion of slat material directly over the slit outwardly bending.

Figure 5:
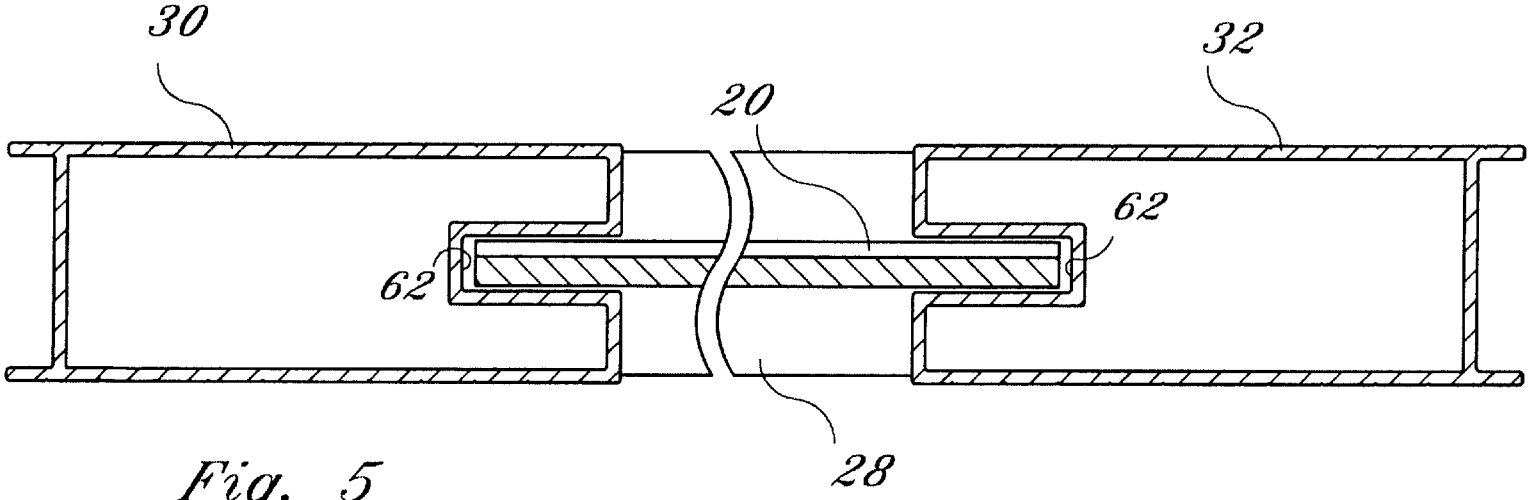
FIG. 5 is a cross-sectional view taken along line 5–5 in FIG. 2.

Referring now to FIG. 5, the position of slats 20 in vent jamb 30 can be seen. Vent jambs 30 and 32 are wider in the present invention that in the prior art, as seen in FIGS. 3 and 4 of '477 , to accommodate greater rabbet depths 62.

The embodiment described above is similar in exterior appearance, though contains significant structural differences, to the device disclosed in the '477 patent, and can be used to retrofit existing installation of the type of the '477 patent. However, other embodiments are possible utilizing the present invention to provide for entirely new installations. The present invention is preferably used with bahamian and sliding type panels, though such should not be considered limiting.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A high impact storm shutter slat for a sliding or bahamian type panel comprising:

a rigid body portion having a first end and a second end;

a slightly bulbous circular surface associated with the first end of said body portion and having at least one shoulder adjacent said body portion;

an enlarged circular surface associated with the second end of said body portion and having a central aperture and a slot; and at least one flange connected to said enlarged circular surface, said at least one flange protruding into said aperture adjacent said slot;

wherein said central aperture is sized slightly larger than said slightly bulbous circular surface, and wherein said at least one flange is positioned to capture said at least one shoulder for rigid adjacent interconnection of a plurality of said high impact storm shutter slats; wherein interconnection of adjacent slots includes insertion of said bulbous circular surface within said central aperture; wherein said slightly bulbous circular surface of an adjacent storm shutter slat virtually consuming all of said central aperture when said slightly bulbous circular surface is received by said enlarged circular surface.

2. A high impact storm shutter slat as claimed in claim 1 wherein said storm shutter slat is made of aluminum.

3. A high impact storm shutter slat as claimed in claim 1 wherein said body portion is at least 0.062 inches thick.

4. A high impact storm shutter slat as claimed in claim 1 wherein said body portion is substantially 0.062 inches thick.

5. A high impact storm shutter slat of claim 1 wherein said plurality of high impact storm shutter slats are adapted for use with sliding and bahamian type frame assemblies.

6. A high impact storm shutter slat as claimed in claim 1 wherein there are two shoulders and two flanges, a first of said two flanges disposed on a first side of said slot and a second of said two flanges disposed on a second side of said slot, said flanges preventing substantial movement of said bulbous disposed within said central aperture to provide for a rigid substantially unmovable connection of adjacent storm shutter slats.

7. A high impact storm shutter as claimed in claim 6 wherein each of said flanges is positioned to simultaneously capture a respective one of said shoulders for rigid interconnection of adjacent high impact storm shutter slats.

8. A high impact storm shutter slat as claimed in claim 1 wherein said body portion includes at least one aperture for ventilation and passage of light.

9. A high impact storm shutter slat for a sliding or bahamian type panel comprising:

a body portion having a first end and a second end;

said first end having a slightly bulbous circular surface having at least one shoulder adjacent said body portion;

said second end having an enlarged circular surface having a central aperture and a slot; and at least one flange connected to said enlarged circular surface, said at least one flange protruding into said aperture adjacent said slot;

wherein said central aperture is sized slightly larger than said slightly bulbous circular surface, and wherein said at least one flange is positioned to capture said at least one shoulder for rigid adjacent interconnection of a plurality of said high impact storm shutter slats; wherein interconnection of adjacent slots includes insertion of said bulbous circular surface within said central aperture; wherein said slightly bulbous circular surface of an adjacent storm shutter slat virtually consuming all of said central aperture when said slightly bulbous circular surface is received by said enlarged circular surface;

wherein said body portion having a bend parallel to and near said first end, said first end and said bend define a first plane, said body portion defining a second plane wherein said first plane and said second plane are not coplanar; and wherein said slot disposed parallel to said first plane and facing opposite said first end.

10. A high impact storm shutter slat as claimed in claim 9 wherein said body portion includes at least one aperture for ventilation and passage of light.

11. A high impact storm shutter slat of claim 9 wherein the connection of a plurality of high impact storm shutters slats are adapted for use with sliding and bahamian type shutter frame assemblies.

12. A storm shutter slat of claim 11 wherein said storm shutter slat is used in combination with a frame assembly with said frame assembly comprising:

an upper frame member having means for connecting to an upper slat of said plurality of interconnected slats;

a lower frame member having means for connecting to a lower slat of said plurality of interconnected slats;

a first and second vertical frame member, said first vertical frame member connected to said upper and lower frame members and capturing the first end of each slat of said plurality of interconnected slats, said second vertical frame member connected to said upper and lower frame members and capturing the second end of each slat of said plurality of interconnected slats to provide for a rigid high impact storm shutter assembly.

13. A storm shutter slat panel as claimed in claim 12 wherein said upper frame member and said lower frame member of the frame assembly, used in combination with said storm shutter slat, includes means for slidably moving the connected plurality of storm shutter slats.

14. A high impact storm shutter slat as claimed in claim 9 wherein said body portion having a thickness of at least 0.062 inches; said body portion having a neck portion between said bend and said first end, said neck portion having a thickness slightly less than said thickness of said body portion; said slot sized to movably fit said neck portion.

15. A high impact storm shutter slat as claimed in claim 14 wherein said body portion has a thickness of substantially 0.062 inches and said neck portion has a thickness of substantially 0.046 inches.

16. A high impact storm shutter slat as claimed in claim 15 wherein said slat is made of extruded aluminum.

* * * * *